US010151462B1

(12) United States Patent
Satterfield et al.

(10) Patent No.: US 10,151,462 B1
(45) Date of Patent: Dec. 11, 2018

(54) STRUCTURAL BEAM AND LIGHT FIXTURE FOR A WALKABLE CLEAN ROOM CEILING

(71) Applicant: AES Clean Technology, Inc., Montgomeryville, PA (US)

(72) Inventors: Louis C Satterfield, Gwynedd, PA (US); Robert G. Satterfield, Ambler, PA (US); Robert J Bright, Sellersville, PA (US); Robert J Geiger, North Wales, PA (US); Richard Dobson, Flowery Branch, GA (US)

(73) Assignee: AES Clean Technology, Inc., Montgomeryville, PA (US)

( * ) Notice: Subject to any disclaimer, the term of this patent is extended or adjusted under 35 U.S.C. 154(b) by 0 days.

(21) Appl. No.: 15/892,569

(22) Filed: Feb. 9, 2018

Related U.S. Application Data

(63) Continuation-in-part of application No. 15/176,605, filed on Jun. 8, 2016.

(51) Int. Cl.

| | |
|---|---|
| ***F21S 8/00*** | (2006.01) |
| ***F21V 21/04*** | (2006.01) |
| ***F21S 8/02*** | (2006.01) |
| *F21Y 115/10* | (2016.01) |
| *F21V 31/00* | (2006.01) |
| *F21V 3/00* | (2015.01) |
| *F21Y 103/10* | (2016.01) |

(52) U.S. Cl.
CPC ..... *F21V 21/048* (2013.01); *F21S 8/026* (2013.01); *F21V 3/00* (2013.01); *F21V 31/005* (2013.01); *F21Y 2103/10* (2016.08); *F21Y 2115/10* (2016.08)

(58) Field of Classification Search
CPC ..... F21V 21/048; F21V 3/00; F21V 31/005; F21S 8/026; F21S 8/043; F21Y 2103/10; F21Y 2115/10
USPC ..... 362/150
See application file for complete search history.

(56) References Cited

U.S. PATENT DOCUMENTS

| | | | |
|---|---|---|---|
| 6,230,463 | B1 | 5/2001 | Bodine |
| 7,621,090 | B2 | 11/2009 | Kelly |
| 2006/0010812 | A1 | 1/2006 | Jones |
| 2008/0229680 | A1 | 9/2008 | Jahn |
| 2015/0038084 | A1 | 11/2015 | Ryder |

*Primary Examiner* — Bao Q Truong
*Assistant Examiner* — Meghan Ulanday
(74) *Attorney, Agent, or Firm* — Robert J. Yarbrough; Lipton, Weinberger & Husick

(57) ABSTRACT

A structural beam and light fixture for a walkable ceiling of a clean room is composed of an elongated channel and a lamp disposed in the elongated channel. The lamp is configured to direct light through the bottom side of the elongated channel. The structural beam and light fixture is attached to adjoining ceiling components and is configured to support a load applied to the adjoining ceiling components. The structural beam and light fixture, combined with other walkable ceiling components, define ceiling top and bottom sides that are flush.

19 Claims, 15 Drawing Sheets

STRUCTURAL BEAM AND LIGHT FIXTURE FOR A WALKABLE CLEAN ROOM CEILING

I. STATEMENT OF RELATED APPLICATIONS

This application is a continuation-in-part of U.S. Non-Provisional patent application Ser. No. 15/176,605 filed Jun. 8, 2016. Application Ser. No. 15/176,605 is hereby incorporated by reference as if set forth in full herein.

II. BACKGROUND OF THE INVENTION

A. Field of the Invention

The Invention relates to clean rooms, such as clean rooms used to control contamination in the pharmaceutical and electronics industries. The Invention is a structural beam and light fixture for use in a walkable ceiling of a clean room and is a ceiling that includes the structural beam and light fixture. The Invention also is a method of constructing a walkable ceiling using the structural beam and light fixture. The structural beam and light fixture of the invention strengthens the walkable ceiling and eliminates a tripping hazard to persons walking on the walkable ceiling.

B. Statement of the Related Art

Clean rooms are used to control the environment and prevent contamination of product, equipment, materials and processes in the pharmaceutical, biotechnology, life sciences and technology industries. A clean room may take the form of a building-within-a-building, with a clean room envelope within a larger building envelope. The larger building protects the clean room from the elements, contains mechanical systems serving the clean room and may provide structural support to the clean room. The clean room provides a discrete space in which the operator can separately control the temperature, humidity, cleanliness and air pressure.

For a walkable-ceiling clean room system, the ceiling structure is adequately robust to support not only the ceiling but also to support human beings walking upon the top of the ceiling. The walkable ceiling allows the operator to access mechanical systems of the clean room and to access the clean room structure itself from the top of the ceiling of the clean room, reducing the need for space-consuming cat walks and scaffolding.

Walkable-ceiling clean rooms may utilize composite construction, with the walls and ceiling composed of opposing steel panels bonded to an aluminum honeycomb core. For reduced weight and cost, the composite panels are constructed to be as thin as possible, consistent with the structural requirements of the ceiling and walls.

For uses in which avoiding biological contamination is a priority, the clean room may provide features allowing thorough disinfection of the clean room without damage to the clean room or to the surrounding building. For example, the walls, floor, ceiling, junctions, and penetrations of the walls, floors or ceiling may be constructed to allow the operator to apply powerful chemical cleaners and disinfectants to the clean room surfaces without damage to the clean room structure and without escape of those powerful cleaners and disinfectants to the building envelope. The composite panels comprising the walls and ceiling of the clean room may be coated with polyvinyl chloride (PVC) during manufacture. When the panels are assembled on site, the fit between the panels is adequately close that the PVC coating on a panel may be chemically welded to the PVC coating on an adjacent panel, sealing the junction between the panels and preventing microorganisms or disinfectants from traveling through the junction. The PVC coating prevents the powerful cleaners and disinfectants from damaging the structure of the clean room walls or ceiling.

Fluorescent fixtures generally light current-technology clean rooms. The fluorescent fixtures penetrate the ceiling panels through holes cut through the ceiling panels. The ceiling panels support the weight of the heavy fluorescent fixtures. The holes cut in the ceiling panels weaken the structure of the ceiling panels, reducing the additional load that the walkable ceiling panels can support and reducing the distance that can be spanned by the ceiling panel without unacceptable deformation. As a result, the construction of the ceiling panels must be more robust, and hence more expensive, than would be required if holes were not cut in the ceiling panels to support the heavy fluorescent fixtures.

Current technology fluorescent fixtures generally penetrate the ceiling from below and are prevented from pulling through the opening in the ceiling panel by a frame and gasket surrounding the fluorescent light fixture. The frame and gasket present an interruption in the otherwise smooth surface of the ceiling and hence may provide a location where residual biological or chemical contaminants may avoid the effects of cleaners and disinfectants. The frame and gasket mounting of current technology clean room lighting systems also interferes with the aesthetically pleasing smooth appearance of the clean room ceiling.

Because of the relatively thin construction of the composite panels dictated by weight and cost constraints, some current-technology fluorescent fixtures penetrate the composite walkable ceiling panels and extend above the top of the ceiling panels. Those fluorescent fixtures present obstructions and a potential tripping hazard for persons walking on the top of the walkable ceiling.

In general, a clean room is manufactured in a factory and the completed components of the clean room are transported to the installation site for assembly. Because of the precision fit required between components, openings for light fixtures in the ceiling panels generally are cut at the factory. If a purchaser of a clean room system issues a change order or if a change in the lighting plan is otherwise made during or after installation of the clean room, one or more ceiling panels must be cut at the factory to receive the selected fluorescent fixtures and the cut ceiling panels shipped to the site of the installation. Installation and operation of a clean room using lighting mounted in holes cut in the ceiling panels is therefore less flexible and more expensive than would be the case if lighting was not installed in factory-cut holes in ceiling panels.

III. BRIEF SUMMARY OF THE INVENTION

The Invention is a light fixture incorporating a structural beam and is configured to define a portion of the top and bottom surfaces of a walkable ceiling of a clean room. The Invention is also a walkable ceiling for a clean room utilizing the lighting fixture. The structural beam and light fixture is itself walkable in that it can support the weight of a human being walking on the top of the clean room ceiling and on the top of the structural beam and light fixture. The structural beam and light fixture also reinforces adjacent ceiling panels or other ceiling components and increases the strength and stiffness of the walkable ceiling compared to a ceiling that does not include the structural beam and light fixture. The structural beam and light fixture of the invention is capable of sharing a load applied to an adjacent ceiling panel and is capable of transferring a load to the adjacent ceiling panel.

The ceiling panels of the clean room have opposing steel skins bonded to an aluminum honeycomb core. To support the ceiling panels, extruded aluminum 'flush beams' extend between the tops of opposing clean room walls or are disposed at the top of the clean room walls. Each flush beam has a portion with a box-shaped cross section. The top of the flush beam defines a channel. The channel can receive one or more cable or rod fasteners for attachment to cable or rod ends. The other ends of the cables or rods attach to the building structure and can support the flush beam intermediate to the opposing walls. Each flush beam defines a shelf at the bottom of the flush beam extending the length of the flush beam. Each flush beam shelf has an upright ridge that extends the length of the flush beam shelf. Each object, such as a ceiling panel or structural beam and light fixture that is supported by the flush beam rests upon the shelf. The ridge of the flush beam shelf engages a mating groove in the object supported by the shelf. The ridge and mating groove align the flush beam and the object supported by the flush beam during installation.

Extruded aluminum hook ends are disposed at opposing ends of the ceiling panels and of the structural beam and light fixture and engage the shelves and upright ridges of opposing flush beams.

The structural beam and light fixture defines a slot extending the length of the light fixture on either side of the light fixture. The slots of the light fixture correspond in location to slots defined by other ceiling components on either side of the light fixture, such as ceiling panels or other structural beams and light fixtures. A connecting spline is inserted into adjoining slots during installation, sealing the junction between adjacent ceiling components. The connecting spline may be composed of a metal, such as aluminum, or a polymer and prevents or reduces liquid or gas penetration between adjacent ceiling components.

The connecting spline also serves to transmit a load applied to one component to adjacent components, such as other structural beam and light fixtures or ceiling panels. For example, a load applied to the top of a ceiling panel by a person walking on top of the ceiling may be transmitted to an adjacent structural beam and light fixture by the connecting spline. The connecting splines therefore structurally join the structural beam and light fixture to other ceiling components.

The structural beam and light fixture is the same thickness as the flush beams and ceiling panels used to construct the ceiling. As a result, the top side of the structural beam and light fixture is flush to the top surface of the ceiling panels and the top surface of the flush beams and does not present an obstruction or other tripping hazards to persons walking on top of the walkable ceiling. The bottom side of the structural beam and light fixture also is flush with the bottom side of the ceiling panels and the flush beams, so the surface of the ceiling visible to a person in the clean room is smooth, other than for small linear depressions indicating the junction between adjacent ceiling components.

Because the use of the structural beam and light fixture allows use of ceiling panels that do not include holes cut to receive light fixtures, the ceiling panels are inherently stronger and can span greater distances without unacceptable deformation. Conversely, ceiling panels may be constructed of thinner, lighter, less-expensive materials than ceiling panels that feature holes cut to receive light fixtures.

As an alternative to the ceiling construction described above, the ceiling may dispense with flush beams to support the other ceiling components. Instead, each of the components of the ceiling, including the structural beams and light fixtures, ceiling panels, utility chases and any other components, define slots in each of its four sides. Each slot is disposed opposite a slot in an adjoining ceiling component. Each pair of adjoining components is connected by a spline mating with the adjoining slots. Because of the lack of flush beams, the ceiling components are suspended directly from the building structure, generally by rod or cables attached to plates bolted to the ceiling components. For this alternative ceiling construction, the structural beam and light fixture described above dispenses with the hook ends at the opposing ends of the structural beam and light fixture. Instead, the structural beam and light fixture features slots at the opposing ends that correspond to slots in adjacent ceiling components. The structural beam and light fixture is attached to adjoining ceiling components by splines in slots on each of the opposing ends and by splines in slots on opposing sides of the structural beam and light fixture. In all other respects, the structural beam and light fixture of the alternative ceiling is the same as the structural beam and light fixture of the ceiling utilizing flush beams and as described above.

The bottom side of the light fixture and structural beam may be coated with PVC and may be solvent-welded to adjoining ceiling components to seal the junction between the light fixture and structural beam and other ceiling components, as against the passage of biological or other contaminants and against the passage of disinfectants. Alternatively, the bottom side of the light fixture and structural beam may be composed of powder-coated aluminum and the junction with other ceiling components may be sealed with a suitable sealant, such as a silicone caulk.

IV. BRIEF SUMMARY OF THE DRAWINGS

V DESCRIPTION OF AN EMBODIMENT

The Invention is a structural beam and light fixture 2 for the walkable ceiling 4 of a clean room 6. The Invention is also a walkable ceiling 4 of a clean room 6 with the structural beam and light fixture 2 installed. The Invention is also a method for constructing the walkable ceiling 4 of a clean room 6.

Figure 1:
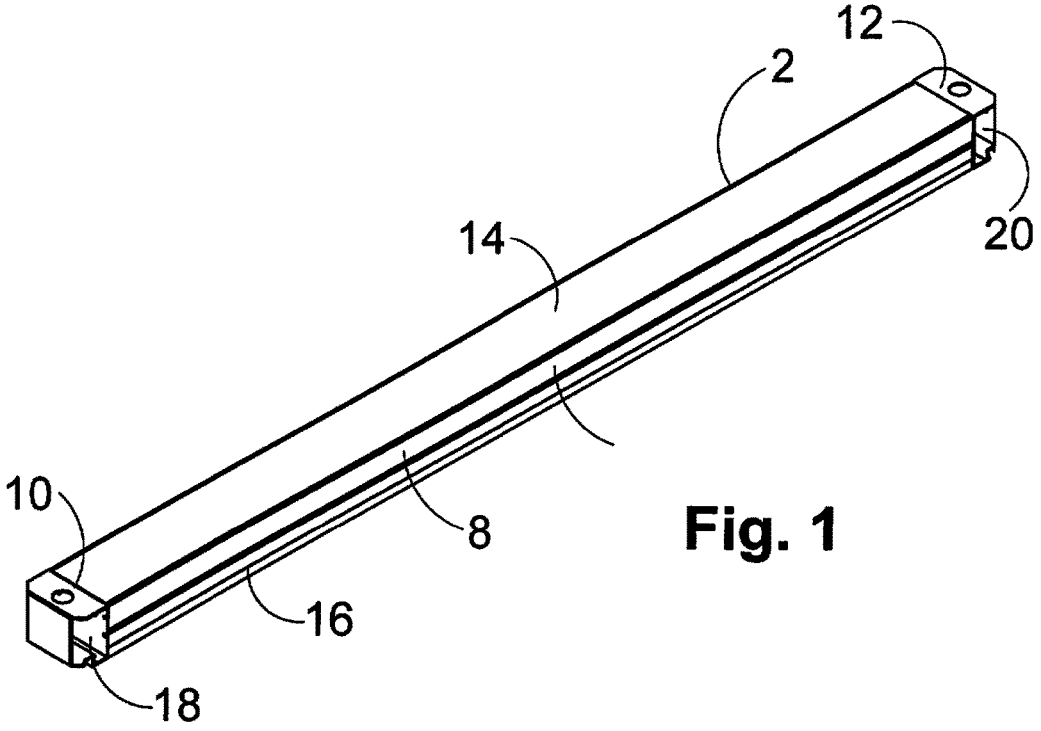
FIG. 1 is a perspective view of the structural beam and light fixture of the invention from above.
Figure 2:
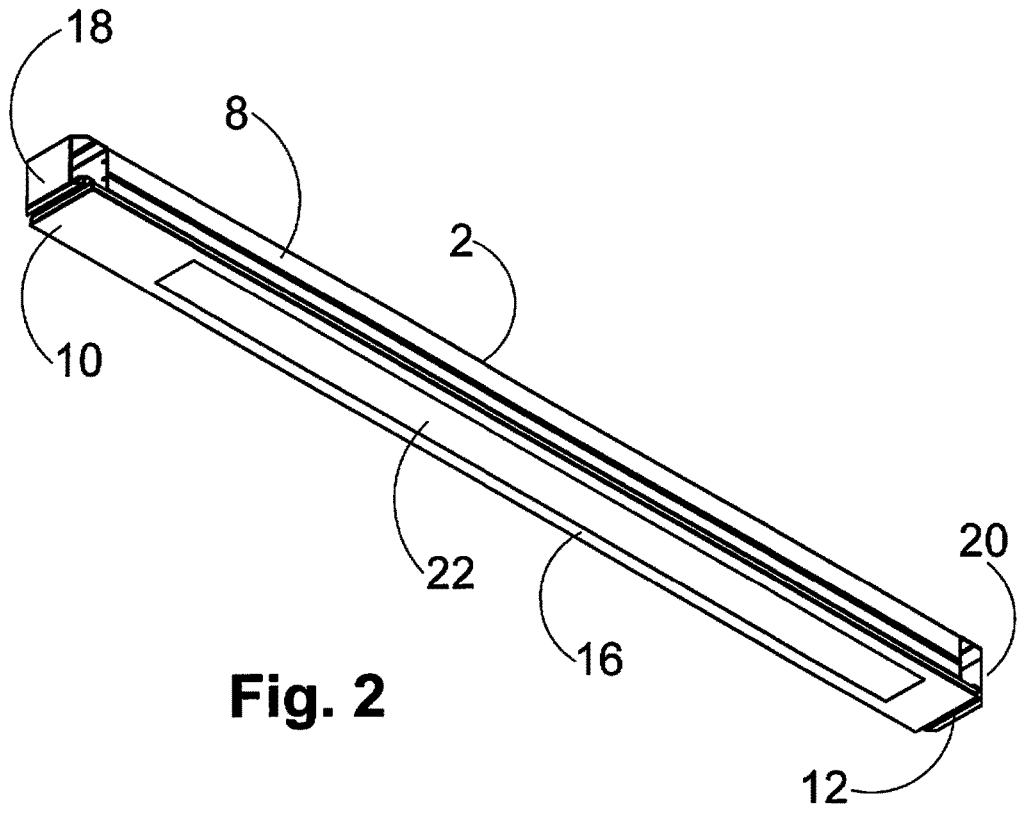
FIG. 2 is a perspective view of the structural beam and light fixture from below.

FIGS. 1 and 2 are perspective views of the structural beam and light fixture 2 of the invention from above (FIG. 1) and from below (FIG. 2). The structural beam and light fixture 2 includes and elongated channel 8 and has a first channel end 10 and a second channel end 12. The elongated channel 8 has a channel top side 14 and a channel bottom side 16. The elongated channel 8 may be composed of extruded aluminum and is sufficiently robust so that the elongated channel is walkable; that is, the elongated channel 8 will support at least the weight of an adult human being without undue deformation when the structural beam and light fixture 2 is supported by the channel first end 10 and the channel second end 12.

A first hook end 18 is disposed at the channel first end 10. A second hook end 20 is disposed at the channel second end 12. The pair of Hook ends 18, 20 allow other walkable ceiling 4 components to support the structural beam and light fixture 2, as discussed below.

Figure 3:
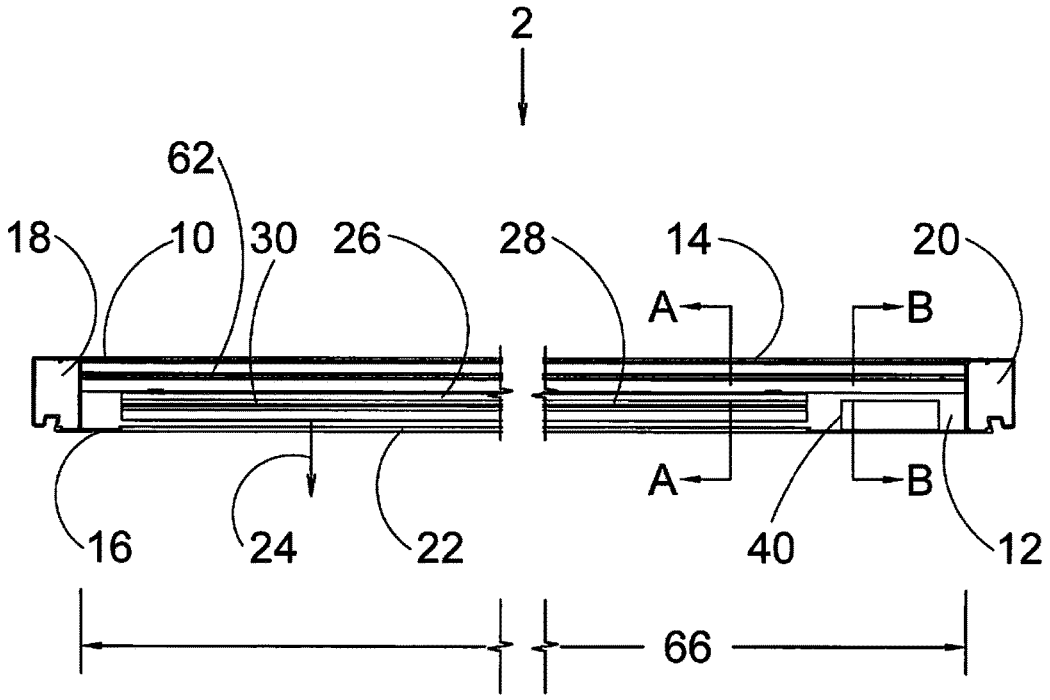
FIG. 3 is a sectional side view of the structural beam and light fixture of the invention.
Figure 4:
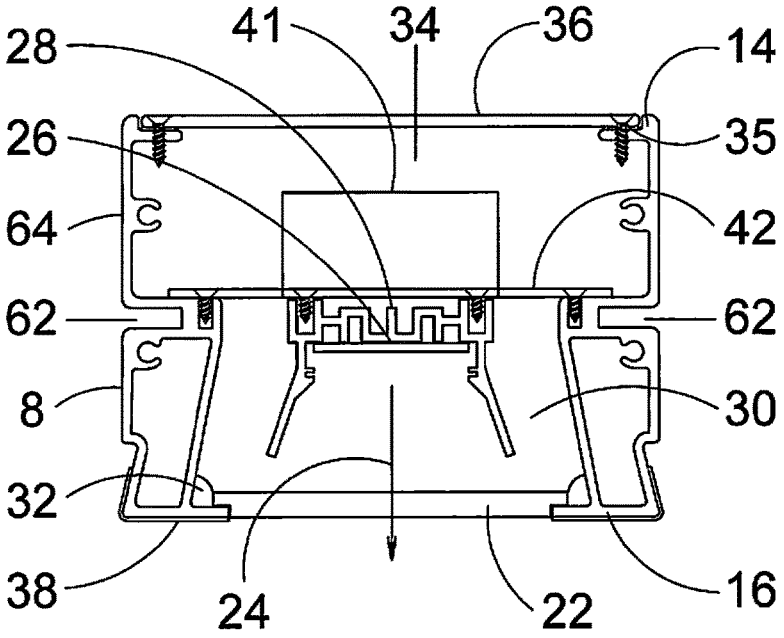
FIG. 4 is a sectional end view of the structural beam and light fixture of the invention.
Figure 5:
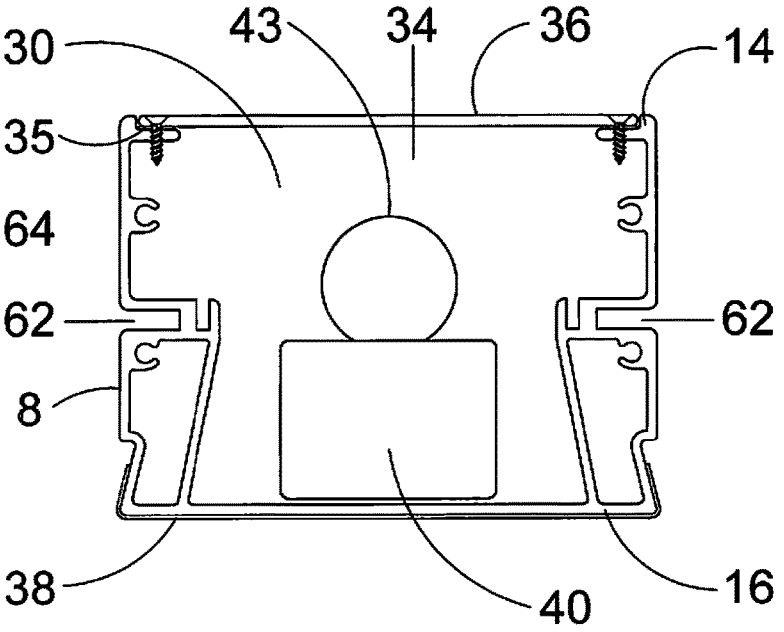
FIG. 5 is a second sectional end view of the structural beam and light fixture of the invention.
Figure 6:
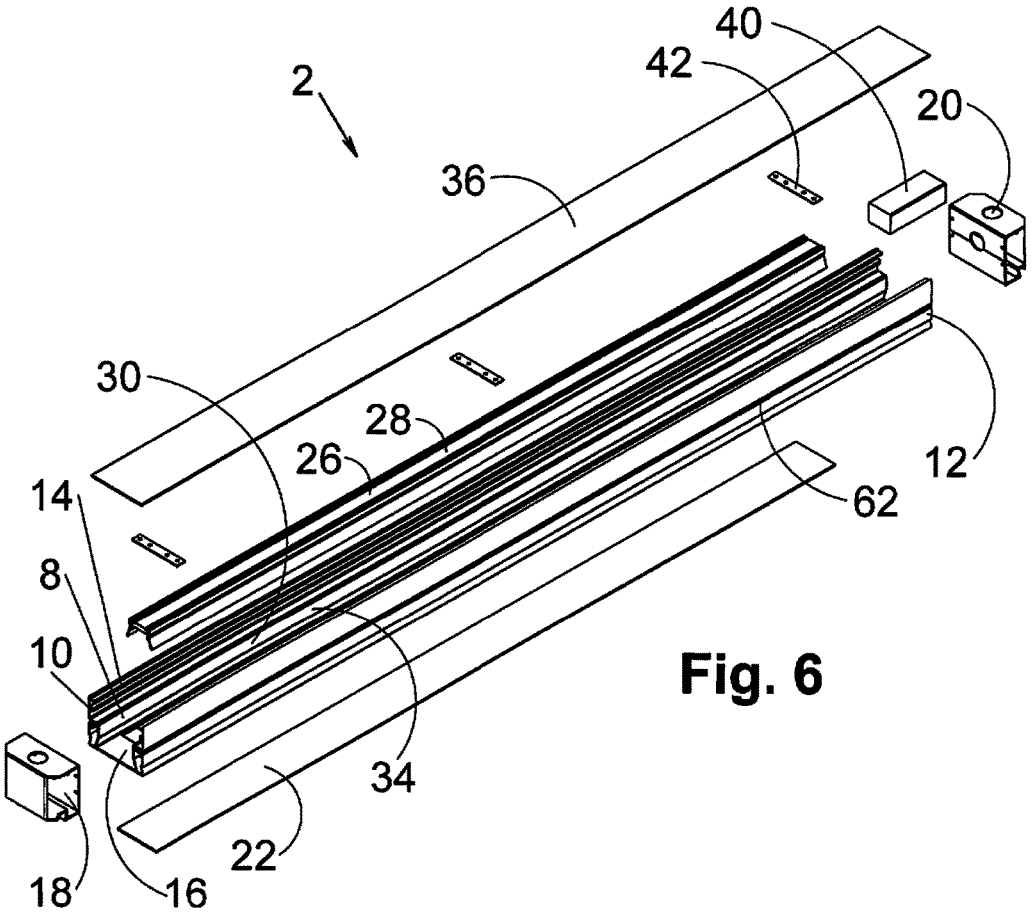
FIG. 6 is an exploded view of the structural beam and light fixture of the invention.

FIGS. 3, 4 and 5 are sectional views of the structural beam and light fixture 2. FIG. 3 is a sectional side view of the structural beam and light fixture 2. FIGS. 4 and 5 are sections A-A and B-B, respectively, of FIG. 3. FIG. 6 is an exploded view of the structural beam and light fixture 2, showing its component parts.

As shown by FIGS. 2, 3, 4 and 6, the channel bottom side 16 features a light-transmitting panel 22. The light-transmitting panel 22 allows light 24 from a lamp 26 located within the interior volume 30 of the elongated channel 8 to pass through the channel bottom side 16. The lamp 26 may be an LED light fixture 28, although a lamp 26 utilizing any technology is contemplated by the invention. The light-transmitting panel 22 engages the channel bottom side 16 at a gas-tight junction 32. The junction 32 is sealed to prevent movement of air, fluids, dust or microorganisms through the junction 32 between the light-transmitting panel 22 and the channel bottom side 16. The light-transmitting panel 22, the channel bottom side 16 and the junction 32 are configured so that the light-transmitting panel 22 and the channel bottom side 16 are flush and substantially smooth. Because of the sealed junction 32, the interior volume 30 of the elongated channel 8 is not accessible without damage to the structural beam and light fixture 2 from the channel bottom side 16 or from inside the clean room 6 when the structural beam and light fixture 2 is installed in the clean room ceiling 4.

As shown by FIGS. 2, 3, 4, 5 and 6, the channel top side 14 defines an access opening 34. The access opening 34 allows access to the interior volume 30 of the elongated channel 8 when the structural beam and light fixture 2 is installed in the walkable ceiling 4 of the clean room 6. A cover 36 selectable covers the access opening 34 and is sealed with a gasket 35. When the cover 36 is in place on the access opening 34 and the structural beam and light fixture 2 is installed in the walkable ceiling 4, the cover 36 or the cover 36 combined with the channel top side 14 are flush with the ceiling top side and the component tops sides of the other modular components of the walkable ceiling 4.

As shown by FIGS. 4 and 5, the channel bottom side 16 is coated with polyvinyl chloride (PVC). The PVC coating 38 provides an easy-to-clean surface and protects the structure of the elongated channel 8 from powerful cleaners and disinfectants applied to the underside of the clean room ceiling 4. The PVC coating 38 allows the modular components of the clean room ceiling 4 to be chemically welded to one another to seal the underside of the clean room ceiling 4 to prevent biological or chemical contaminants from entering the clean room 6 from the spaces between the ceiling 4 components. The PVC coating 38 also provides a substantially smooth and aesthetically pleasing appearance to the underside of the clean room ceiling 4.

FIGS. 4, 5 and 6 also shows the power supply 40 for the lamp 26 or LED light fixture 28 and brackets 42 that support the lamp 26 or LED light fixture 28 in the elongated channel 8. FIG. 4 also shows the LED controller 41 and FIG. 5 shows the opening 43 through which electrical power wires enter the structural beam and light fixture 2.

FIGS. 7 through 11 illustrate example configurations of the walkable ceiling 4 assembled to include the structural beam and light fixture 2. The components 50 of the walkable ceiling 4 are modular, allowing a designer to design the ceiling by selecting among a multiplicity of possible combinations and orientations of the modular components 50. All possible arrangements of the modular components 50 and of the structural beams and light fixtures 2 are contemplated by the Invention.

Figure 7:
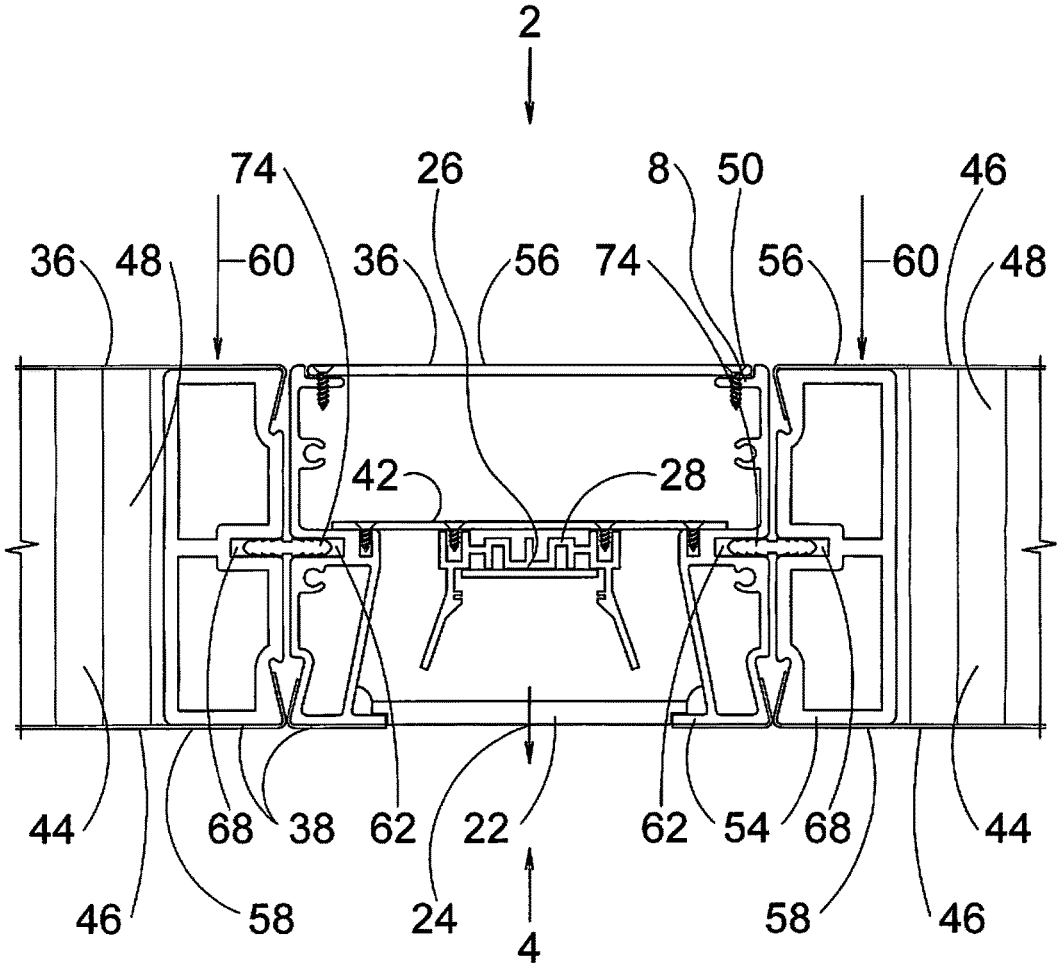
FIG. 7 is a detail sectional view of a portion of the clean room ceiling showing two ceiling panels joined to a structural beams and light fixture.

As shown by the sectional view of FIG. 7, the structural beam and light fixture 2 may be combined in the walkable ceiling 4 with another ceiling component 50. The 'another ceiling component' 50 has a component top side 52 and a component bottom side 54. Because of the modular nature of the walkable ceiling 4, the "another ceiling component" 50 may be any of a plurality of components 50 in any suitable arrangement. In the example of FIG. 7, the structural beam and light fixture 2 is combined with another structural beam and light fixture 2 and a composite panel 44. The second structural beam and light fixture 2 and the composite panel 44 of FIG. 7 are the "another ceiling components" 50 of that example.

The structural beams and light fixtures 2 of FIG. 7 are as described above relating to FIGS. 1-6. The composite panel 44 features opposing skins 46 and a core 48. The core 48 is bonded to the skins 46. The skins 46 may be composed of any suitable material having suitable strength and toughness, such as sheet steel. The core 48 may be composed of any suitable material that imparts sufficient stiffness in flexion to the composite panel 44, such as crenellated aluminum.

FIG. 7 also illustrates that the structural beam and light fixture 2 and the other components 50 of the walkable ceiling 4 in combination define the ceiling top side 56 and the ceiling bottom side 58. The ceiling top side 56 is substantially flat and unobstructed by the structural beam and light fixture 2 and by the other components 50. Similarly, the structural beam and light fixture 2 and the other components 50 of the walkable ceiling 4 in combination define the ceiling bottom side 58. The ceiling bottom side 58 is substantially flat and substantially smooth. Also from FIG. 7, the PVC coating on the channel bottom side 16 and the component bottom side 54 is chemically welded during installation, sealing the ceiling bottom side 58.

FIG. 7 also illustrates how a load 60 applied to the ceiling top side 56 is transferred to the structural beam and light fixture 2. Each structural beam and light fixture 2 is configured with a channel slot 62 defined by the elongated channel 8. The channel slot 62 is disposed on the side 64 of the elongated channel 8 that is adjacent to the "another ceiling component" 50. As shown by FIG. 3, the channel slot 62 extends the length 66 of the elongated channel 8. From FIG. 7, a component slot 68 is defined by the ceiling component 50 adjacent to the structural beam and light fixture 2. The component slot 68 runs the length 70 of the other component 50 and is disposed on the side 72 of the other component 50 adjacent to the structural beam and light fixture 2. The locations of the component slot 68 and channel slot 62 correspond so that the slots 68, 62 are directly opposite one another. A connecting spline 74 is disposed in both the channel slot 62 and the component slot 68 and extends the length of the elongated channel 8 and the other component 50. The connecting spline 74 joins the structural beam and light fixture 2 to the other component 50 and provides an additional seal between the structural beam and light fixture 2 and the other component 50. The connecting spline 74 also joins the structural beam and light fixture 2 and other component 50 structurally, so that a load 60 applied to the component top side 52 is transferred by the connecting spline 74 to the structural beam and light fixture 2. In a similar manner, a load 60 applied to the channel top side 14 is transferred by the connecting spline 74 to the adjacent other component 50. The connecting spline 74 may be composed of a polymer or of any other suitable material that will both seal the connection between the two components 2, 50 and that will provide a structural connection between the two components 2, 50.

Supporting by the elongated channel 8 of the load 60 applied to the other component 50 of the ceiling 4 makes the ceiling 4 stiffer and stronger than it would otherwise be, allowing otherwise identical other components 50 to span longer distances than would otherwise be the case, or allowing the other components 50 to be constructed from lighter, thinner, weaker and hence less expensive materials than would otherwise be the case.

Figure 8:
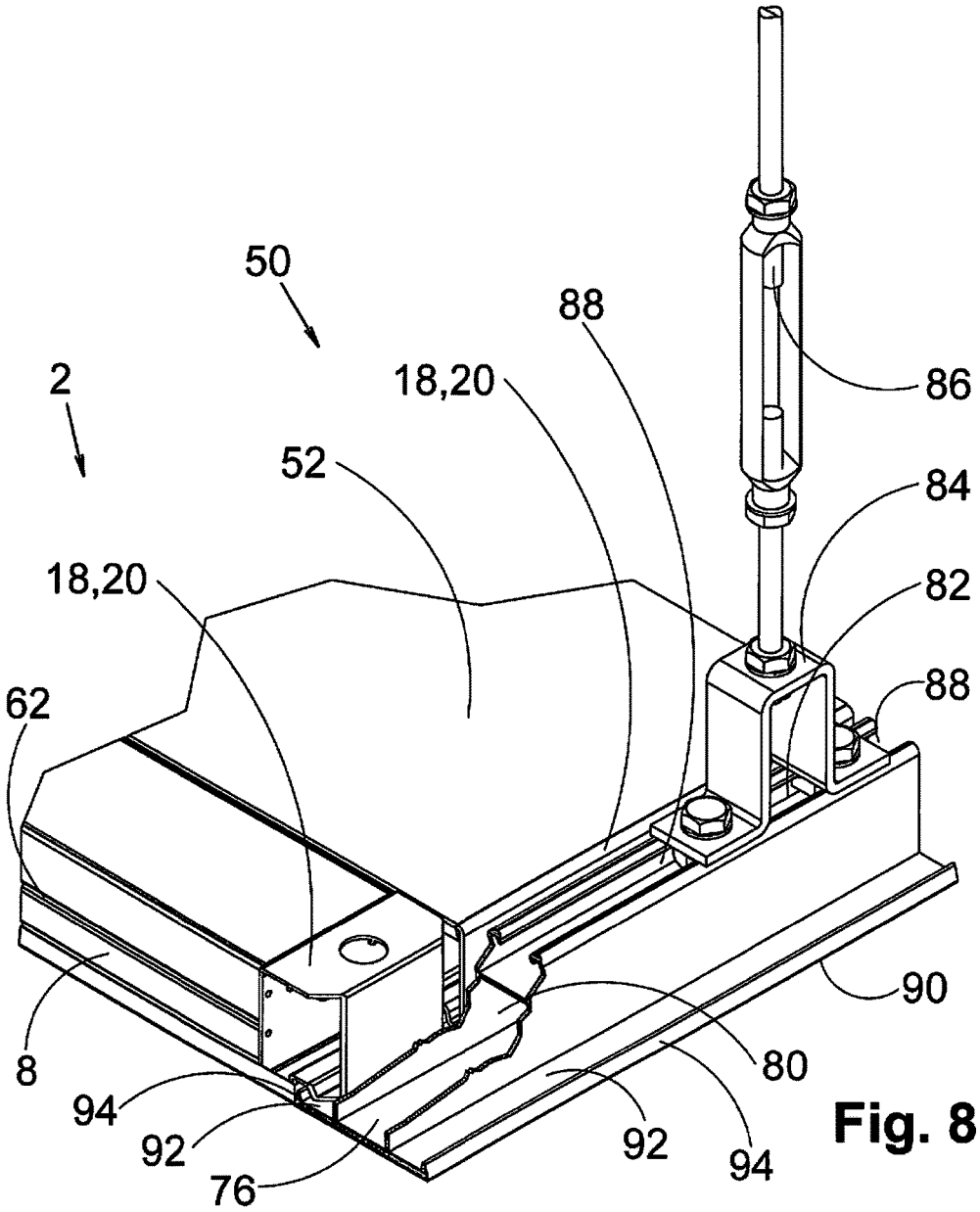
FIG. 8 is a detail cutaway view of a walkable ceiling including a flush beam, an elongated channel and a composite panel.

FIG. 8 illustrates that all of the components 50 of the walkable ceiling 4 are supported by an opposing pair of flush beams 76, 78. FIG. 8 is a detail cutaway view of a walkable ceiling 4 including a first flush beam 76, an elongated channel 8 and a composite panel 44. The flush beams 76, 78 are the principal structural component of the walkable ceiling 4 and support the other components 50, including the structural beam and light fixture 2.

As shown by FIG. 8, each flush beam 76, 78 includes a robust box section 80 that has flush beam top side 88. The flush beam top side 88 defines a T-channel 82. The T-channel 82 is configured to receive and retain a T-fastener 84. The T-fastener 84 is slidable within the T-channel 82. The T-fastener 84 is attached to a cable or rod 86 that is suspended from the structure of the building that houses the clean room 6. The building supports the cable or rod 86, the cable or rod 86 supports the T-fastener 84, the T-fastener 84 supports the flush beam 76, 78, and the flush beam 76, 78 supports the ceiling components 50, including the structural beam and light fixture 2.

From FIG. 8, the flush beam 76, 78 has a lower side that defines a shelf 92. The shelf 92 extends from either side of the flush beam 76, 78. Each shelf 92 defines a ridge 94. The shelf 92 and ridge 94 extend the length of the flush beam 76, 78. The hook ends 18, 20 that are attached to opposing ends of the elongated channel 8 engage and are supported by the shelves 92 of two opposing flush beams 76, 78. The ridges 94 align and retain the hook ends 18, 20, and hence the structural beam and light fixture 2, during installation and maintenance, reducing the opportunity for mishap should a hook 19, 20 unintentionally become disengaged from its mating shelf 92.

Figure 9:
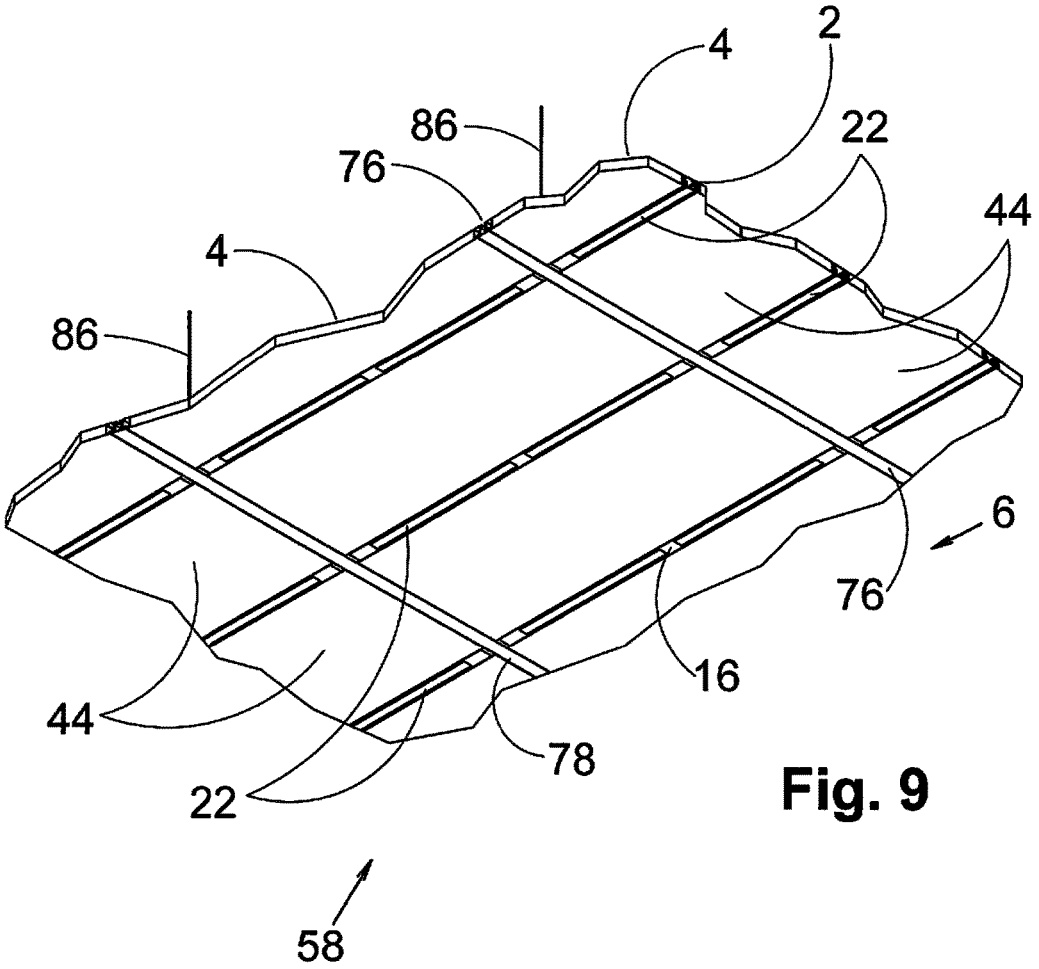
FIG. 9 is a perspective view of the underside of a clean room ceiling using the light fixture of the invention.

FIG. 9 is a detail perspective view of an example ceiling bottom side 58 of a walkable ceiling 4 of a clean room 6 using the structural beam and light fixture 2 of the invention. The flush beam bottom side 90, the component bottom side 54 and the structural beam and channel bottom side 16 are flush and in combination define the ceiling bottom side 58. The ceiling bottom side 58 is flat and substantially smooth. As noted, the components 50 of the walkable ceiling 4 are modular and may be in installed any arrangement to meet the needs of a particular clean room 6 design.

Figure 10:
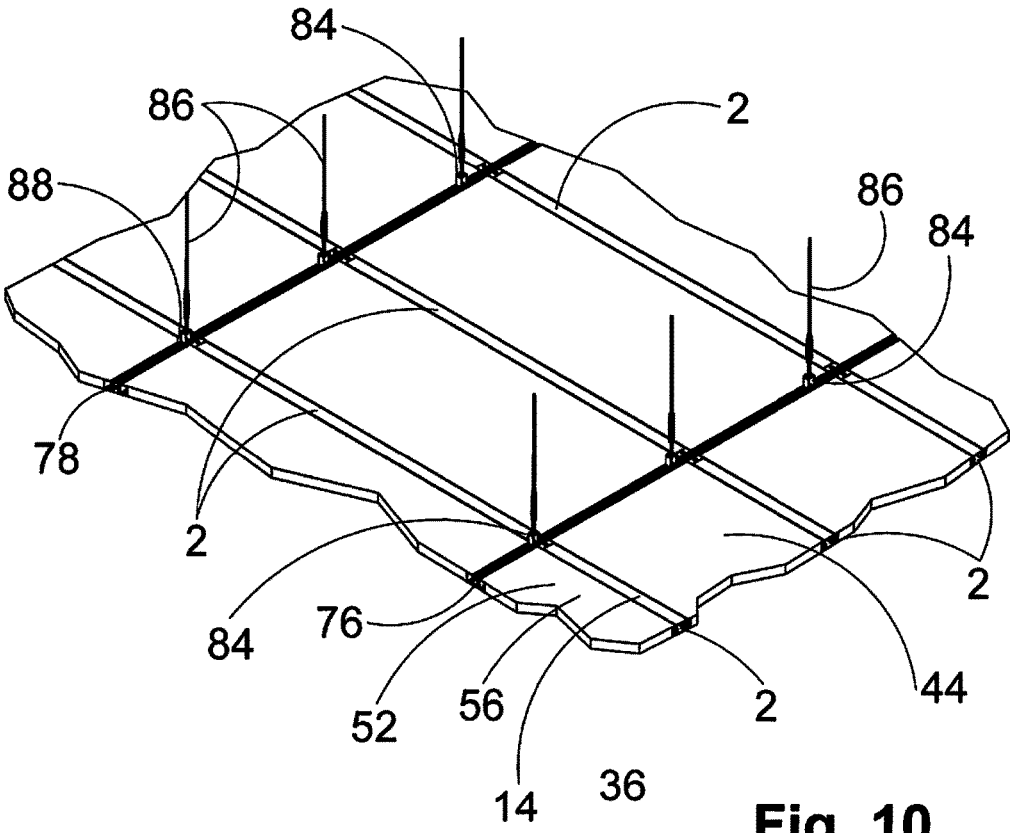
FIG. 10 is a perspective view of the upper side of the clean room ceiling using the light fixture of the invention.

FIG. 10 is a perspective view of the ceiling top side 56 of the walkable ceiling 4 of the clean room 6 using the structural beam and light fixture 2 of the invention. The flush beam top side 88, the component top sides 52, and the channel top side 14, and the cover 36 are flush and together define the ceiling top side 56. The ceiling top side 56 is substantially flat. As noted above, the ceiling top side 56 is interrupted by rods or cables 86 supporting the flush beams 76, 78 and may be interrupted by ventilation or other utilities serving the clean room 6.

Figure 11:
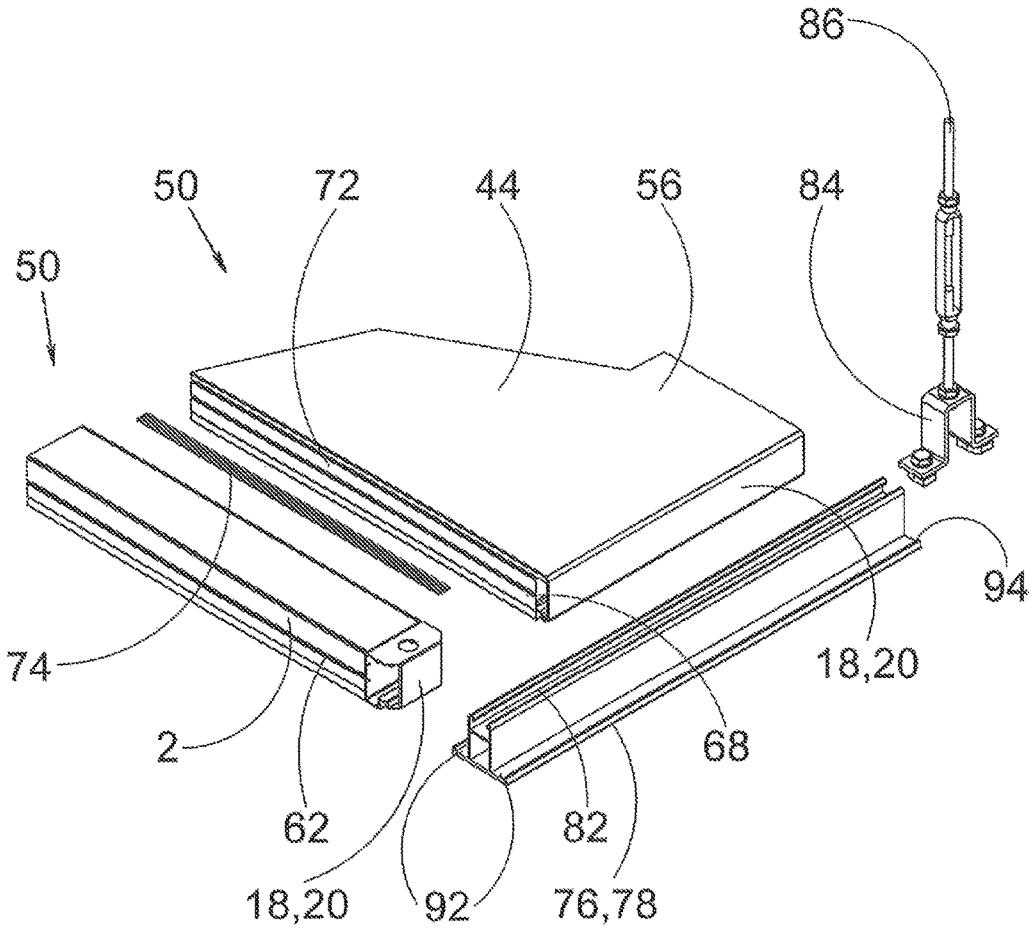
FIG. 11 is an exploded view of the walkable ceiling.

FIG. 11 is an exploded view of an example portion of the walkable ceiling 6. As noted above, the ceiling components 50 are modular. The ceiling components 50, including the structural beam and light fixture 2 and the composite panel 44, may be interchangeably supported by opposing flush beams 76, 78 as needed for a particular clean room 6 design. Also as noted above, the ceiling components 50 are flush on both the ceiling top side 56 and the ceiling bottom side 58 so that the ceiling top side 56 is walkable without obstruction from the ceiling components 50 and so that the ceiling bottom side 58 is easily cleaned and disinfected. The ceiling bottom side 58 also has a pleasing, substantially smooth appearance from inside the clean room 6.

Figure 12:
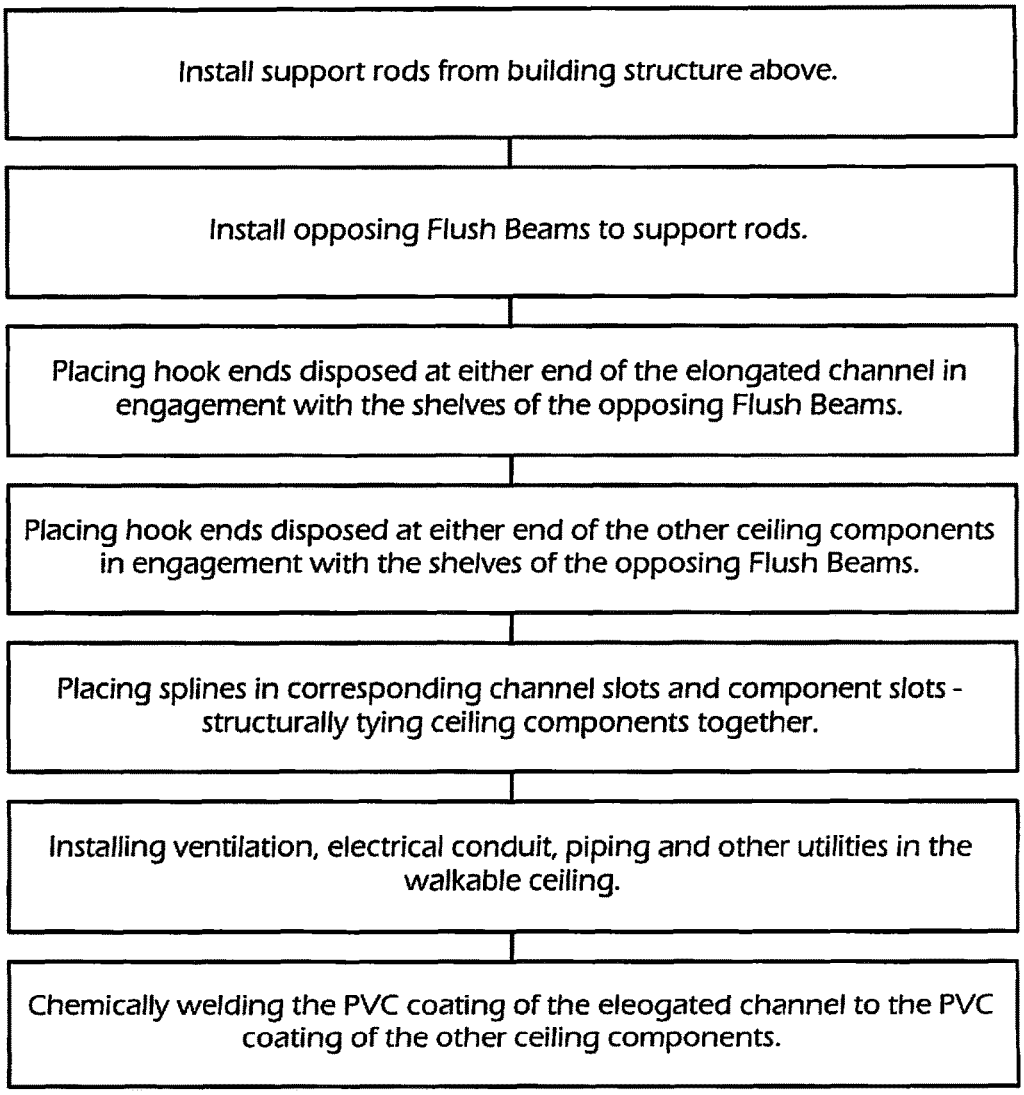
FIG. 12 is a flow chart of the method of the invention.

FIG. 12 is a flow chart of the method of installing the walkable ceiling 4 of the clean room 6. To install the structural beam and light fixture 2 of the invention, installers will install opposing flush beams 76,78. Each of the flush beams 76, 78 defines a shelf 92 that extends the length of the flush beam 76, 78 and that provides support for the structural beam and light fixture 2 and that provides support for the other ceiling components 50. In installing the flush beams 76, 78, the installers may suspend the flush beams 76, 78 from the structure of the building housing the clean room 6 using rods or cables that are attached at one end to the building structure and at the other end to T-fasteners 84 that are trapped in T-channels 82 defined by the flush beam top sides 88. The installers then will place the hook ends 18, 20 disposed on opposite ends 10, 12 of the elongated channel 8 in engagement with the shelves 92. The shelves 92 of the opposing flush beams 76, 78 support the hook ends 18, 20 and the hook ends support the elongated channels 8. As described above, the elongated channels 8 contain lamps 26 to direct light 24 through the bottom side 16 of the elongated channel 8.

The installers also will engage the shelves 92 with hook ends 18, 20 attached to opposing sides of other ceiling components 50, supporting the other components 50 from the flush beams 76, 78. The installers will place connecting splines 74 in corresponding channel slots 62 and component slots 68, sealing the junction between the elongated channel 8 and the other component 50 and allowing the elongated channel 8 to support a load 60 applied to the ceiling top side 56 at the other component 50. The installer will chemically weld the PVC coating 38 the channel bottom side 16 and the component bottom side 54. Installation of ventilation and other utilities completes the walkable ceiling 4.

Figure 13:
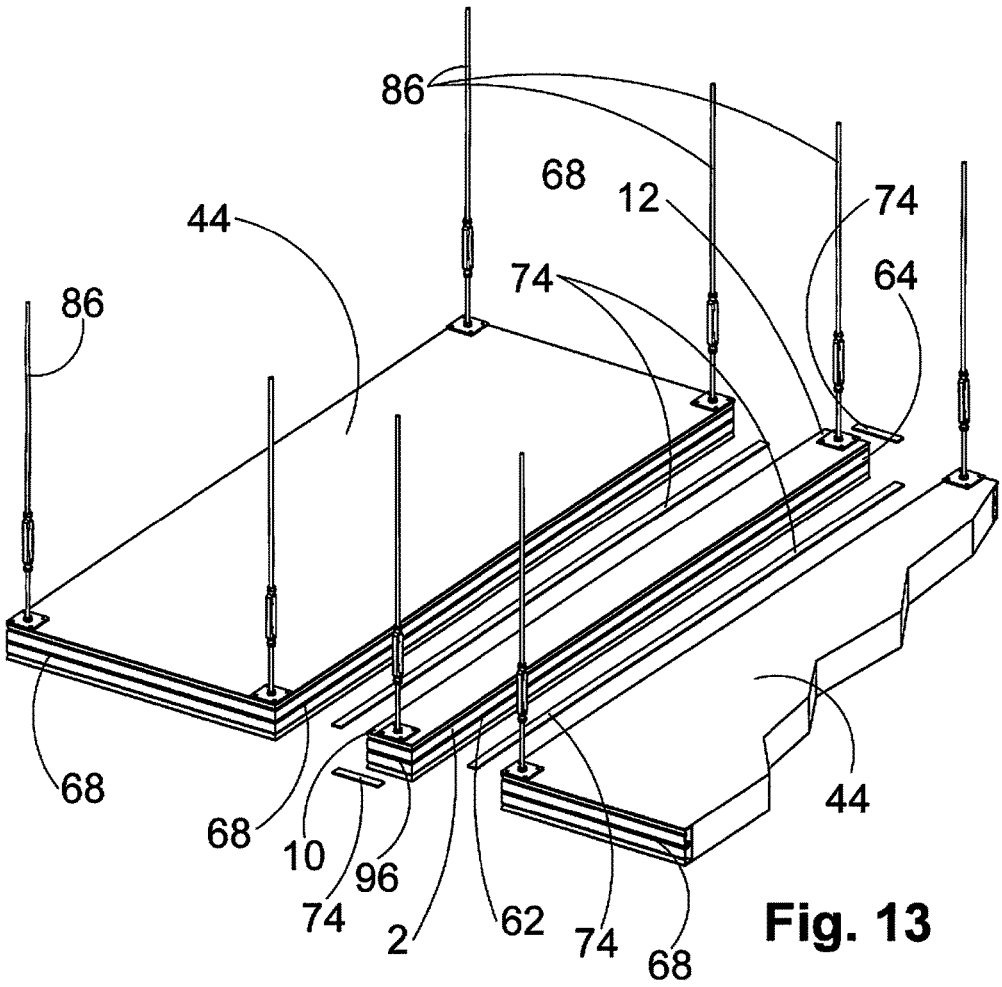
FIG. 13 is an exploded perspective view of a walkable ceiling of an alternative embodiment.

FIG. 13 is an exploded perspective view of an alternative to the ceiling 4 construction described above. In the ceiling of FIG. 13, flush beams 76, 78 do not support the ceiling 4. For the alternative ceiling 4 construction of FIG. 13, the structural beam and light fixture 2 described above dispenses with the hook ends 18, 20 at the opposing ends 10, 12 of the structural beam and light fixture 2. Instead, the structural beam and light fixture 2 features end slots 96 at the opposing ends 10, 12 that correspond to component slots 68 in adjacent ceiling components 50. The structural beam and light fixture 2 is attached to adjoining ceiling components 50 by splines 74 in end slots 96 on each of the opposing ends 10, 12 and by splines 74 in channel slots 62 on opposing sides 64 of the structural beam and light fixture 2. Each channel slot 62 and end slot 96 is disposed opposite a component slot 68 in an adjoining ceiling component 50. Each pair of adjoining components 2, 50 is connected by a spline 74 mating with the adjoining slots 62, 96, 68. Because of the lack of flush beams 76, 78, the ceiling components 50 are suspended directly from the building structure, generally by rod or cables 86 attached to plates bolted to the ceiling components 2, 50. In all other respects, the structural beam and light fixture 2 of the alternative ceiling 4 is the same as the structural beam and light fixture 2 of the ceiling 4 utilizing flush beams 76, 78 and as described above.

FIGS. 14 through 17 show a structural beam and light fixture 2 where the structural beam and light fixture 2 has a body 98 is defined by a single extrusion, such as an aluminum extrusion. The structural beam and light fixture 2 of FIGS. 14-17 differs from that of FIGS. 4-7, which are composed of a two-part extrusion joined together by a bracket 42. For the two-part extrusion, all access to the interior volume 30 of the structural beam and light fixture 2 is from above the clean room ceiling 4, through cover 36, access opening 34 and bracket 42.

Figure 14:
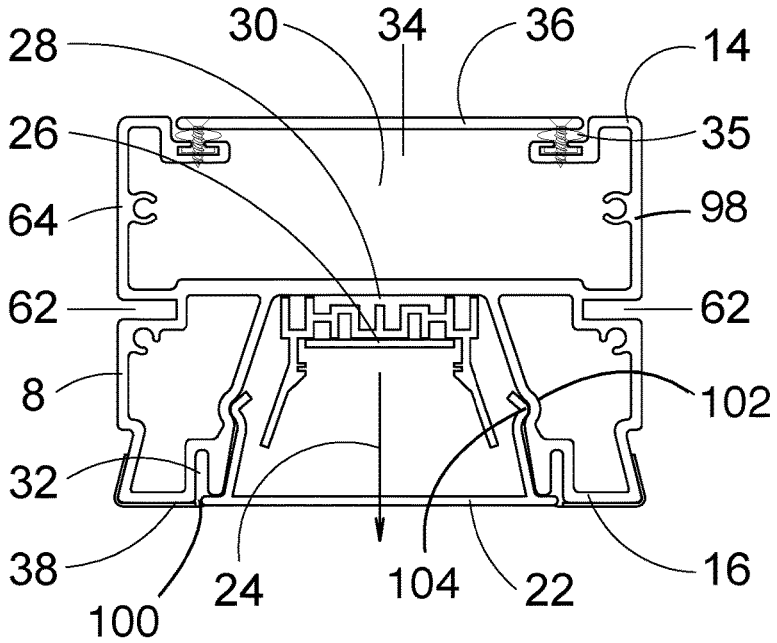
FIG. 14 is a first cross sectional end view of a structural beam and light fixture using a one-piece extrusion.
Figure 15:
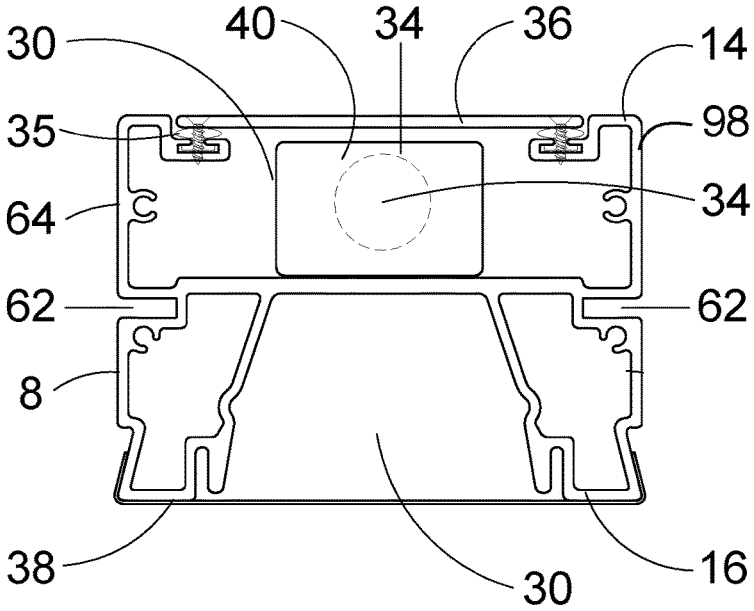
FIG. 15 is a second cross sectional end view of the structural beam and light fixture using the one-piece extrusion.
Figure 16:
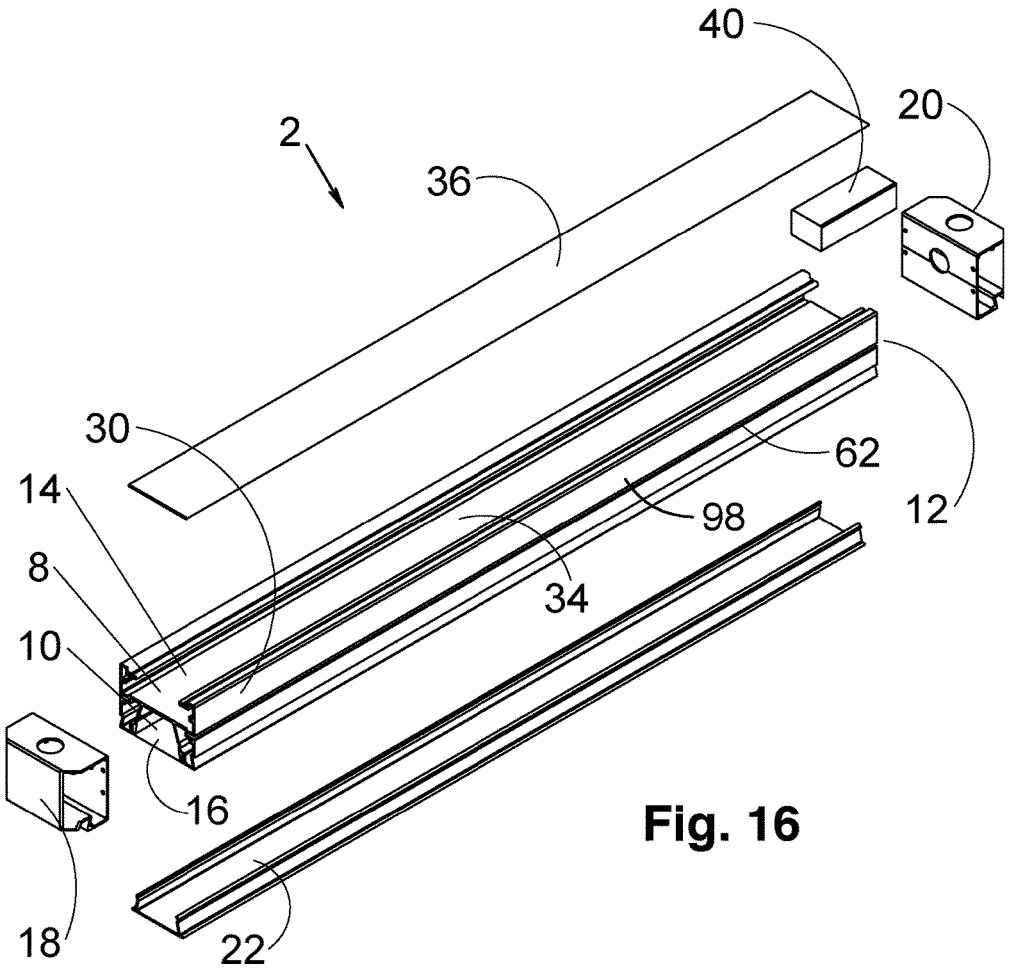
FIG. 16 is an exploded view of the structural beam and light fixture using the one-piece extrusion.
Figure 17:
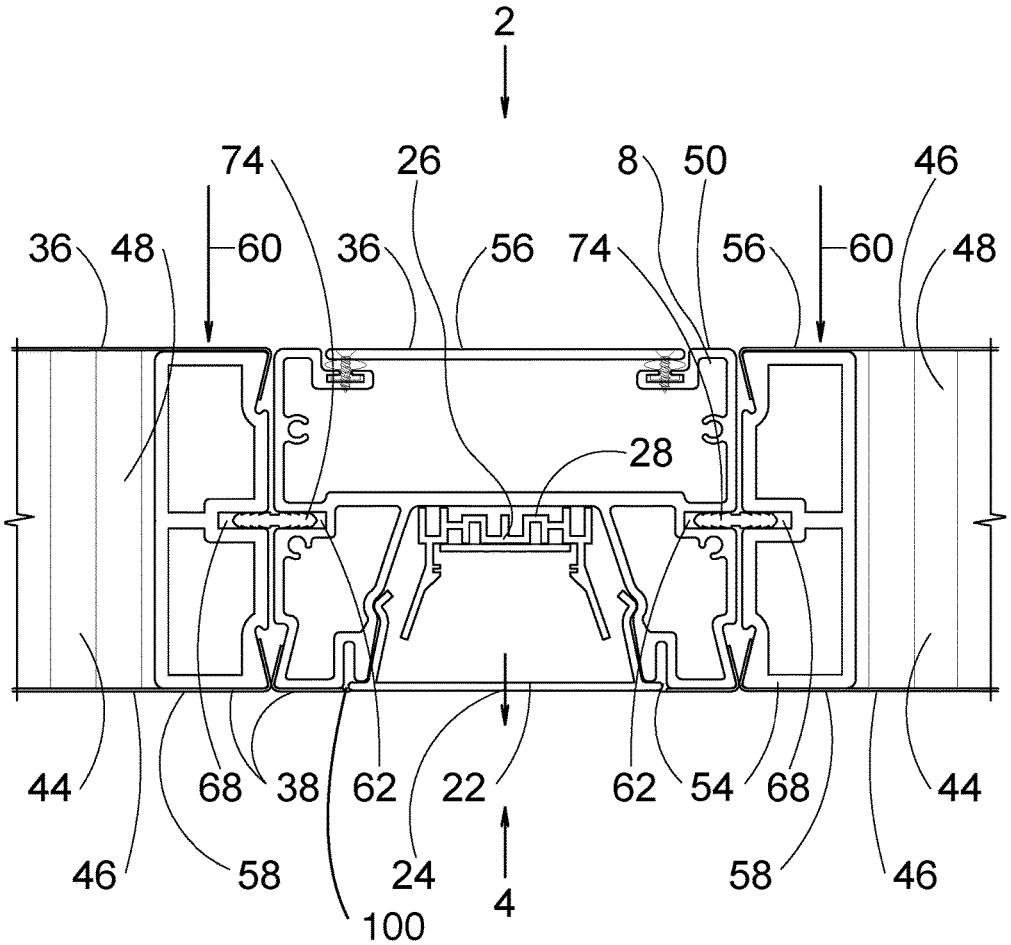
FIG. 17 is a sectional view of a walkable ceiling showing two ceiling panels connected to the structural beam and light fixture using the one-piece extrusion.

For the single extrusion of FIGS. 14-17, access to the interior volume 30 and hence to the LED lamp 26 is from the underside of the clean room ceiling 4 and through the light-transmitting panel 22. For the single extrusion embodiment of FIGS. 14-17, access from the channel top side 14 to the LED lamp 26 is not available because the body 98 blocks access from the top. As shown by FIG. 15, for the single extrusion embodiment of FIGS. 14-17, the power supply 40 is located below the cover 36 and is accessible from the channel top side 14 through the access opening 34.

For the single extrusion embodiment and as shown by FIG. 14, detents 102 in the single extrusion body 98 mate with corresponding resilient structures 104 of the light-transmitting panel 22 and hold the light-transmitting panel 22 in place within the interior volume 30 of the structural beam and light fixture 2. A bead of a sealant 100, such as silicone caulk, seals the light-transmitting panel 22 to the channel bottom side 16 of the structural beam and light fixture 2. If access to the LED lamp 26 in the interior volume 30 of the structural beam and light fixture 2 is required, a technician will remove the sealant 100 and remove the light-transmitting panel 22. When the maintenance task is completed, the technician will replace the light-transmitting panel 22 and re-apply sealant 100 to seal the light-transmitting panel 22 to the channel bottom side 16.

GLOSSARY

The following terms have the following meanings:

'Another Component' means one of the modular components of a clean room ceiling. The term 'another component' may be a composite panel having two opposing skins and a core, may be a utility chase, may be a structural beam combined with a light fixture, or may be any other modular component of a clean room ceiling.

'Flush' as applied to a component of a clean room ceiling means that the component does not extend above or below the other modular components of the clean room ceiling when the clean room ceiling is in place on a clean room. Some supports or accessories of the clean room ceiling, such as cables or rods supporting the flush beams, or ventilation or other utility service penetrating through the clean room ceiling, or ladders, catwalks or scaffolding providing access to the clean room ceiling, will not be 'flush' with the modular components of the clean room ceiling.

'Opposing' means that two objects are in a spaced-apart relation. In reference to flush beams, the opposing flush beams may be several feet apart and support other modular ceiling components between the flush beams. In reference to the opposing skins of a composite panel, the opposing skins are separated by enough distance, on the order of inches or fractions of an inch, to provide adequate structural support to the panel to span the distance between the opposing flush beams and so that the composite panel is walkable without unacceptable deformation.

'Substantially Smooth' as applied to the inside surface of the clean room ceiling means that the surface will appear generally without texture, other than the texture of a coating, such as PVC, on a sheet metal or similar surface. The 'substantially smooth' clean room ceiling will exhibit small indentations at the junction between adjacent ceiling components.

'Walkable' means that the top side of a clean room ceiling or a component of a clean room ceiling can support the weight of an adult human being walking upon the top side of the ceiling without undue deformation of the clean room ceiling or of the component when the ceiling or ceiling component is installed as part of a clean room.

LIST OF NUMBERED ELEMENTS

The following is a list of the numbered elements.

a structural beam and light fixture 2
a walkable ceiling 4
a clean room 6
an elongated channel 8
a channel first end 10
a channel second end 12
a channel top side 14
a channel bottom side 16
a first hook end 18
a second hook end 20
a light-transmitting panel 22
a light 24
a lamp 26
an LED light fixture 28
an interior volume 30 of the elongated channel
a junction 32
an access opening 34
a cover 36
PVC 38
Power supply 40
Bracket 42 a composite panel 44
opposing skins 46
a core of the composite panel 48
another ceiling component 50
a component top side 52
a component bottom side 54
a ceiling top side 56
a ceiling bottom side 58
a load 60
a channel slot 62
a side of said elongated channel 64
a length of said elongated channel 66
a component slot 68
a length of another component 70
a side of the component 72
a connecting spline 74
a first flush beam 76
a second flush beam 78
a box section 80
a T-channel 82
T-fastener 84
Cable or rod 86
a flush beam top side 88
a flush beam bottom side 90
a shelf 92
ridge 94
end slot 96
channel body 98
sealant 100
detent 102
corresponding resilient structure 104

We claim:

1. A walkable structural beam and light fixture for a walkable ceiling of a clean room, the walkable ceiling having a ceiling top side and a ceiling bottom side, the walkable structural beam and light fixture comprising:

(a) an elongated channel, said elongated channel defining a channel first end and a channel second end, said elongated channel having a configuration for support of said elongated channel from said channel first end and said channel second end, said elongated channel being configured to be substantially flush with both the ceiling top side and the ceiling bottom side when said elongated channel is installed in the walkable ceiling, said elongated channel being walkable when said elongated channel is installed in the walkable ceiling;

(b) a lamp, said lamp defining an interior volume, said lamp being disposed within said interior volume, said elongated channel having a channel top side and a channel bottom side, said lamp being configured to project a light through said channel bottom side when said elongated channel is installed in the walkable ceiling;

(c) a light transmitting panel, said light transmitting panel being releasably attached to said channel, said light-transmitting panel being selectably sealable to said channel bottom side, whereby said lamp is accessible through said channel bottom side by releasing said light-transmitting panel from said channel bottom side.

2. The structural beam and light fixture of claim 1 wherein said first and second ends are opposing, said elongated channel also having opposing first and second sides and opposing channel top and bottom sides and wherein said configuration for support of said elongated channel comprising: a pair of hook ends, a one of said hook ends being disposed at said channel first end, another of said hook ends being disposed at said channel second end, said hook ends being configured to engage and to be supported by opposing flush beams when said opposing flush beams and said elongated channel are installed as part of the clean room ceiling, said hook ends being configured to support said elongated channel between said opposing flush beams, said opposing first and second sides not being configured to engage said flush beams when said opposing flush beam and said elongated channel are installed as part of the clean room ceiling.

3. The structural beam and light fixture of claim 2 wherein said elongated channel has a configuration to engage another ceiling component adjacent to said elongated channel when the structural beam and light fixture and said another component are installed in the walkable ceiling, said configuration to engage said another ceiling component providing that said elongated channel supports a load applied to the ceiling top side at said another ceiling component when said elongated channel and said another ceiling component are installed in said walkable ceiling and said load is applied to the top side of the walkable ceiling at said another ceiling component.

4. The structural beam and light fixture of claim 3 wherein said configuration of said elongated channel to engage said another ceiling component comprises: a channel slot defined by said elongated channel and extending a length of said elongated channel, said channel slot being adjacent to a component slot defined by said another ceiling component and extending a length of said another ceiling component when said another ceiling component is supported by said opposing flush beams and adjacent to said elongated channel, said channel slot and said component slot being configured to receive a connecting spline, whereby said connecting spline transfers a load applied to a top side of said another ceiling component to said elongated channel when said elongated channel and said another component are installed in said ceiling and said connecting spline is disposed in said channel slot and said component slot.

5. The structural beam and light fixture of claim 4 wherein said another ceiling component is a composite panel having a pair of opposing skins and a core disposed between said pair of opposing skins.

6. The structural beam and light fixture of claim 4 wherein said another ceiling component is another structural beam and light fixture.

7. The structural beam and light fixture of claim 4 wherein said light fixture is an LED light fixture disposed within said interior volume of said elongated channel.

8. The structural beam and light fixture of claim 1 wherein said elongated channel defines channel slots on opposing sides of said elongated channel, said elongated channel further defining end slots on opposing ends of said elongated channel, said channel slots and said end slots corresponding to component slots on a plurality of other ceiling components, said configuration for support of said elongated channel comprising: each of said channel slots and each of said end slots is configured to receive and to engage a spline that is also in engagement with a component slot of another ceiling component.

9. The structural beam and light fixture of claim 8 wherein said elongated channel is configured to support a load applied to the ceiling top side at said another ceiling component when said elongated channel and said another ceiling component are installed in said walkable ceiling and said load is applied to the top side of the walkable ceiling at said another ceiling component.

10. A walkable ceiling for a clean room, the walkable ceiling having a ceiling top side and a ceiling bottom side, the walkable ceiling comprising:

a. an elongated channel, said elongated channel comprising a channel first end and a channel second end, a channel top side and a channel bottom side, said elongated channel having a first hook end disposed at said channel first end and a second hook end disposed at said channel second end, said channel top side being flush with the ceiling top side;

b. a light-transmitting panel, said light transmitting panel being releasably attached to said channel, said light transmitting panel defining said channel bottom side, said light transmitting panel being flush with said ceiling bottom side, said light transmitting panel and said channel bottom side defining a junction, said junction being sealable;

c. a lamp disposed within an interior volume of said elongated channel, said lamp configured to direct a light through said light transmitting panel and said channel bottom side whereby said lamp is accessible through said ceiling bottom side by selectably releasing said light-transmitting panel from said channel bottom side;

d. a pair of opposing flush beams, said opposing flush beams each defining a flush beam top side and a flush beam bottom side, each said flush beam bottom side defining a shelf, said shelves engaging said hook ends, said shelves of said opposing flush beams supporting said elongated channel between said opposing flush beams.

11. The walkable ceiling of claim 10, the walkable ceiling further comprising: another ceiling component, said another ceiling component having a component top side and a component bottom side, said another component being supported by said shelves of said opposing flush beams adjacent to said elongated channel, said component top side being flush with the ceiling top side, said component bottom side being flush with said ceiling bottom side, said elongated channel engaging said another ceiling component, said elongated channel and said another ceiling component having a configuration so that said elongated channel will support a load applied to said component top side.

12. The walkable ceiling of claim 11 wherein said configuration that said elongated channel will support said load applied to said component top side comprises:

a. a channel slot defined by a side of said elongated channel adjacent to said another ceiling component;

b. a component slot defined by a side of said component adjacent to said ceiling component, said component slot corresponding to said channel slot;

c. a connecting spline disposed within said component slot and said channel slot, said connecting spline extending a length of said elongated channel and a length of said another component, whereby said connecting spline transfers said load applied to said another component to said elongated channel, said elongated channel being configured to support said load.

13. The walkable ceiling of claim 12 wherein said another ceiling component is a composite panel, said composite panel having a opposing skins and a core sandwiched between said opposing skins.

14. The walkable ceiling of claim 12 wherein said another ceiling component is a structural beam and light fixture comprising said elongated channel and said light fixture contained within said interior volume of said elongated channel.

15. A method of constructing a walkable ceiling having a ceiling top side and a ceiling bottom side, the method comprising the steps of:

a. providing a pair of opposing flush beams, said opposing flush beams each defining a flush beam top side and a flush beam bottom side, each said flush beam bottom side defining a shelf;

b. providing an elongated channel, said elongated channel having a first end and a second end, a first hook end being disposed at said first end and a second hook end being disposed at said second end, said elongated channel having a channel top side and a channel bottom side, said elongated channel having a lamp disposed within said elongated channel and configured to direct a light through said channel bottom side c. providing a light transmitting panel, said light transmitting panel being releasably attached to said elongated channel, said light-transmitting panel being selectably sealable to said channel bottom side, whereby said lamp is accessible through said channel bottom side by releasing said light-transmitting panel from said channel bottom side;

d. supporting said first hook end by said shelf of a first of said pair of opposing flush beams;

e. supporting said second hook end by said shelf of a second of said pair said opposing flush beams, said hook ends supporting said elongated channel, whereby said channel bottom side is flush with the ceiling bottom side and said channel top side is flush with the ceiling top side and whereby both the ceiling bottom side and the ceiling top side defined by said pair of flush beams and said elongated channel are substantially smooth.

16. The method of claim 15, the method further comprising:

a. providing another ceiling component, said another ceiling component having a component top side and a component bottom side;

b. installing said another component so that said another ceiling component is supported adjacent to said elongated channel by said shelves of said opposing flush beams;

c. engaging said elongated channel and said another ceiling component, whereby said elongated channel supports a load applied to said component top side and whereby the ceiling top side and the ceiling bottom side defined by said opposing pair of flush beams, said elongated channel and said another component are flush and substantially smooth.

17. The method of claim 16 wherein said step of engaging said channel and said another ceiling component comprises:

a. inserting a connecting spline into a channel slot defined by said channel and extending a length of said channel, said channel slot being adjacent to said another component;

b. inserting said connecting spline into a component slot defined by said another component, said component slot extending a length of said another component, said another component slot being adjacent to said elongated channel, said channel slot corresponding to said component slot, whereby said connecting spline transfers said load applied to said another component to said elongated channel when said elongated channel and said another component are adjacent and supported by said pair of opposing flush beams, said elongated channel being configured to support said load.

18. The method of claim 17 wherein said another ceiling component is a composite panel, said composite panel having opposing skins and a core sandwiched between said opposing skins.

19. The method of claim 17 wherein said another ceiling component is another said elongated channel with and said lamp is contained within said elongated channel.

* * * * *